US010781551B2

(12) United States Patent
Cai et al.

(10) Patent No.: US 10,781,551 B2
(45) Date of Patent: Sep. 22, 2020

(54) STEAM IRON

(71) Applicant: Tsann Kuen (Zhangzhou) Enterprise Co., Ltd., Zhangzhou, Fujian (CN)

(72) Inventors: Ruifeng Cai, Fujian (CN); Xiaosen Sun, Fujian (CN); Jingui Wang, Fujian (CN)

(73) Assignee: Tsann Kuen (Zhangzhou) Enterprise Co., Ltd., Zhangzhou (CN)

( * ) Notice: Subject to any disclaimer, the term of this patent is extended or adjusted under 35 U.S.C. 154(b) by 1 day.

(21) Appl. No.: 16/207,319

(22) Filed: Dec. 3, 2018

(65) Prior Publication Data

US 2019/0169788 A1 Jun. 6, 2019

(30) Foreign Application Priority Data

Dec. 5, 2017 (CN) ..... 2017 2 1673926 U

(51) Int. Cl.

| | |
|---|---|
| ***D06F 75/18*** | (2006.01) |
| ***D06F 75/10*** | (2006.01) |
| ***D06F 75/26*** | (2006.01) |
| ***D06F 75/38*** | (2006.01) |

(52) U.S. Cl.

CPC ..... *D06F 75/18* (2013.01); *D06F 75/10* (2013.01); *D06F 75/26* (2013.01); *D06F 75/38* (2013.01)

(58) Field of Classification Search

CPC ..... D06F 75/18; D06F 75/10; D06F 75/26; D06F 75/38

USPC ..... 38/14, 77.81, 77.7

See application file for complete search history.

(56) References Cited

U.S. PATENT DOCUMENTS 2,815,592 A * 12/1957 Gomersall ..... D06F 75/18 38/77.83
3,881,265 A * 5/1975 Eaton ..... B05B 11/3015 38/77.5
4,398,364 A * 8/1983 Augustine ..... D06F 75/22 38/77.5
4,686,352 A * 8/1987 Nawrot ..... D06F 75/26 200/61.52
4,866,859 A * 9/1989 Kopelman ..... D06F 71/34 34/526
5,209,407 A * 5/1993 Farrington ..... B05B 1/3436 239/491

(Continued)

OTHER PUBLICATIONS

Search Report issued to European counterpart application No. 18209970.5 by the EPO dated Apr. 12, 2019.

*Primary Examiner* — Nathan E Durham
*Assistant Examiner* — Abby M Spatz
(74) *Attorney, Agent, or Firm* — Burris Law, PLLC

(57) ABSTRACT

A steam iron is adapted for ironing a piece of cloth with steam generated thereby. The steam iron includes a machine body unit, a sole plate unit, a water supply unit, a heating unit, and a control unit. The sole plate unit is connected to a bottom end of the machine body unit. The water supply unit is connected to the machine body unit and includes a pump that is adapted for supplying water to the sole plate unit. The heating unit is connected to the sole plate unit and heats up the sole plate unit so that the water supplied to the sole plate unit is heated to form the steam. The control unit is connected to the machine body unit, measures moving speed of the steam iron and controls water output of the pump based on the moving speed of the steam iron.

4 Claims, 4 Drawing Sheets

(56) References Cited

U.S. PATENT DOCUMENTS 5,421,110 A * 6/1995 Morrissey ..... D06F 75/14 137/409
5,446,983 A * 9/1995 Patrick ..... D06F 75/265 38/77.7
5,787,615 A * 8/1998 Hensel ..... D06F 75/22 38/77.5
5,937,552 A * 8/1999 Hall ..... D06F 75/38 38/93
6,243,976 B1 * 6/2001 Beverly ..... D06F 75/14 220/213
6,318,009 B1 * 11/2001 De Maneville ..... D06F 75/18 38/77.8
6,463,685 B1 * 10/2002 Tynes ..... D06F 75/18 38/77.8
6,720,537 B2 * 4/2004 Prager ..... D06F 75/26 219/248
8,365,446 B2 * 2/2013 Ng ..... D06F 81/08 38/77.7
2001/0032403 A1 * 10/2001 Har ..... D06F 75/26 38/77.7
2004/0181979 A1 * 9/2004 Compeau ..... F04B 17/00 38/77.1
2007/0175072 A1 * 8/2007 Lee ..... D06F 75/18 38/77.8
2008/0229628 A1 * 9/2008 Valiyambath Krishnan ..... D06F 75/12 38/77.6
2009/0000161 A1 * 1/2009 Weber ..... D06F 75/18 38/77.7
2010/0116298 A1 * 5/2010 Rosenzweig ..... A47L 13/225 134/105
2010/0122478 A1 * 5/2010 Lee ..... D06F 75/12 38/77.7
2010/0140062 A1 * 6/2010 Hopkins ..... H01H 35/14 200/61.45 R
2010/0242314 A1 * 9/2010 Aiura ..... D06F 75/10 38/77.7
2012/0324768 A1 * 12/2012 Janakiraman ..... D06F 75/18 38/77.81
2013/0125427 A1 * 5/2013 De Vries ..... D06F 75/22 38/14
2017/0167072 A1 6/2017 Wong et al.
2017/0275811 A1 9/2017 Valiyambath Krishnan et al.

* cited by examiner

PRIO ART

STEAM IRON

CROSS-REFERENCE TO RELATED APPLICATION

This application claims priority of Chinese Patent Application No. 201721673926.2, filed on Dec. 5, 2017.

FIELD

The disclosure relates to a steam iron, and more particularly to a steam iron with adjustable steam output.

BACKGROUND

Referring to FIG. 1, a conventional steam iron includes a machine body unit 11, a sole plate unit 12 connected to a bottom end of the machine body unit 11, a water tank unit 13 mounted in the machine body unit 11, a steam unit 14, and a control unit 15.

The sole plate unit 12 includes a sole plate 122 that is adapted for ironing a piece of cloth and that is formed with a plurality of steam holes 121 in fluid communication with the external environment, and a first heating member 123 that is for heating the sole plate 122. The water tank unit 13 includes a water chamber 131 for storing liquid water, a second heating member 132 for heating the liquid water in the water chamber 131, and a water inlet 133 that interconnects the water chamber 131 and the steam unit 14 for transporting the liquid water in the water chamber 131 to the steam unit 14. The steam unit 14 includes a steam chamber 141 that is connected to the water inlet 133 for receiving the liquid water therefrom, a third heating member 142 for evaporating the liquid water into steam by heating, and a steam valve 143 that fluidly communicates the steam chamber 141 and the sole plate 122. The control unit 15 includes a microcontroller 151, and a gyroscope 152 that is electrically connected to the microcontroller 151.

The microcontroller 151 opens or closes the steam valve 143 based off orientation measurement of the conventional steam iron measured and transmitted by the gyroscope 152. For example, when the conventional steam iron is placed in a vertical position, the gyroscope 152 signals the microcontroller 151 to close the steam valve 143, ensuring that the steam in the steam chamber 141 cannot enter the sole plate 122. When the conventional steam iron is placed from the vertical position to a horizontal position, the steam valve 143 is signaled to open, allowing the steam from the steam chamber 141 to pass therethrough for ironing the piece of cloth.

While the abovementioned steam iron is able to open or close the steam valve 143 based off the orientation of the steam iron, it is not capable of controlling the intensity of the steam applied onto the piece of cloth. The design of the heating members 123, 132, 142 also complicates the algorithms needed for the microcontroller 151 to control them simultaneously.

SUMMARY

Therefore, an object of the disclosure is to provide a steam iron that can alleviate the drawback of the prior art.

According to the disclosure, the steam iron is adapted for ironing a piece of cloth with steam generated thereby. The steam iron includes a machine body unit, a sole plate unit, a water supply unit, a heating unit, and a control unit. The sole plate unit is connected to a bottom end of the machine unit. The water supply unit is connected to the machine body unit and includes a pump that is adapted for supplying water to the sole plate unit. The heating unit is connected to the sole plate unit and heats up the sole plate unit so that the water supplied to the sole plate unit is heated to form the steam. The control unit is connected to the machine body unit, measures moving speed of the steam iron and controls water output of the pump based on the moving speed of the steam iron.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
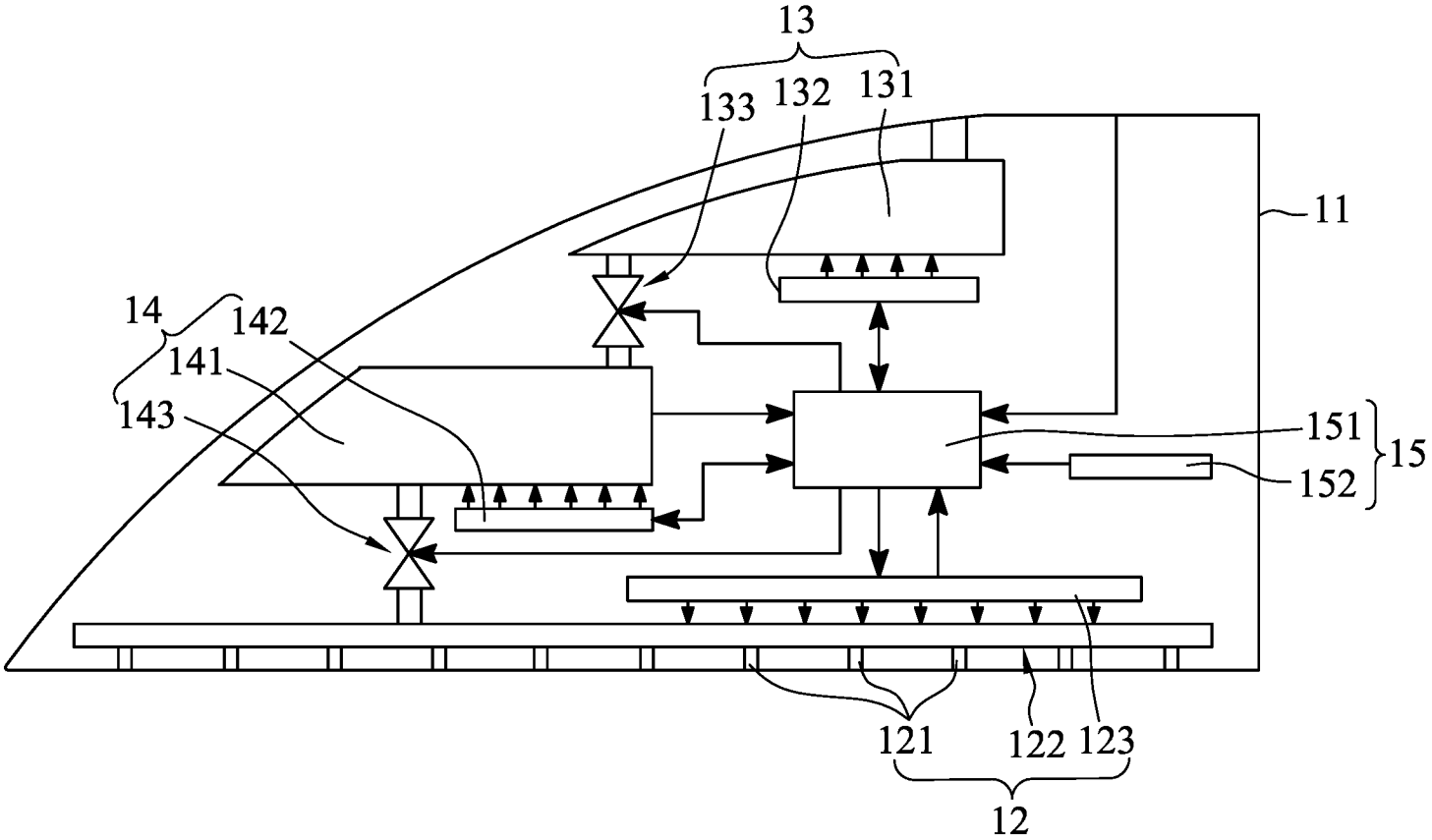
FIG. 1 is a schematic view of a conventional steam iron.
Figure 2:
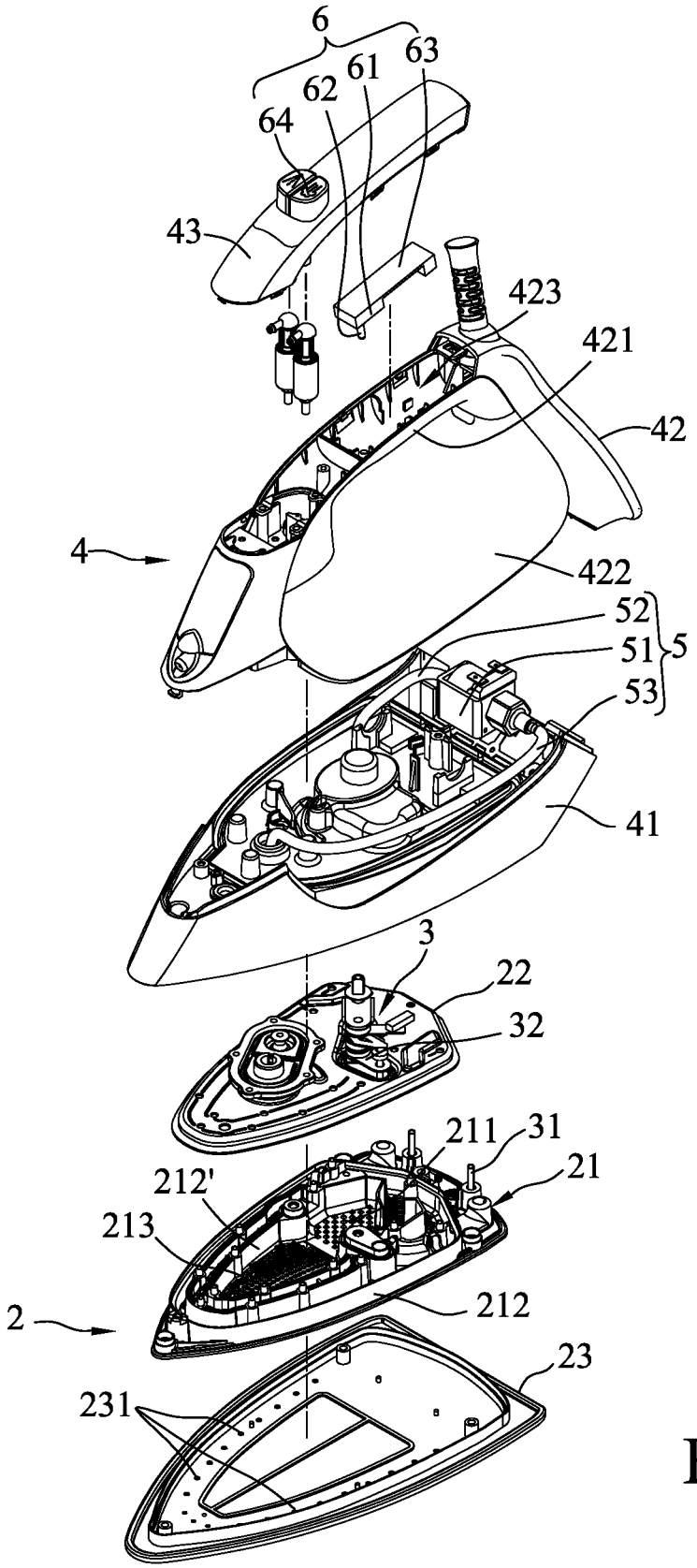
FIG. 2 is an exploded perspective view of an embodiment of a steam iron according to the disclosure.
Figure 3:
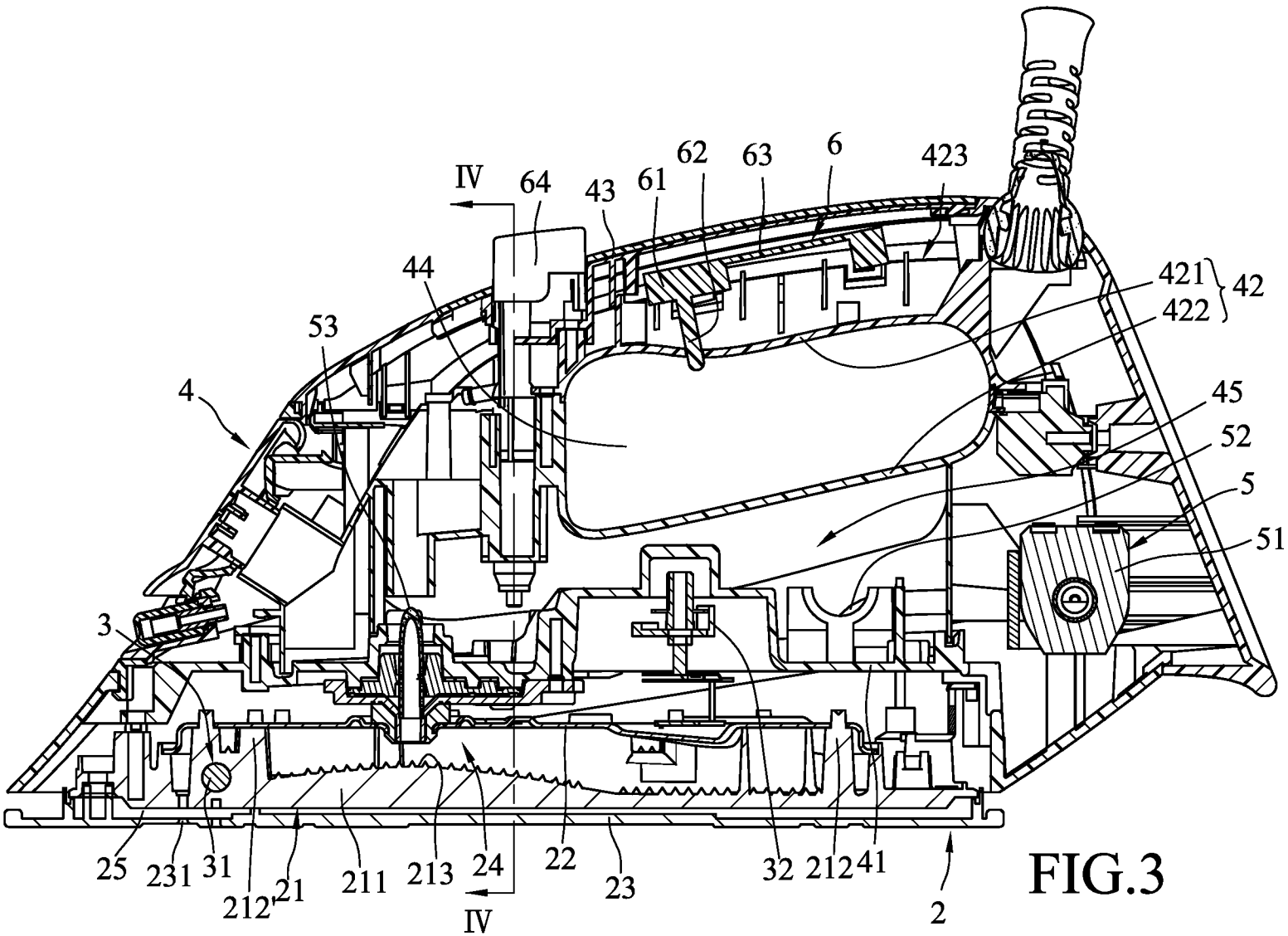
FIG. 3 is a sectional side view of the embodiment.
Figure 4:
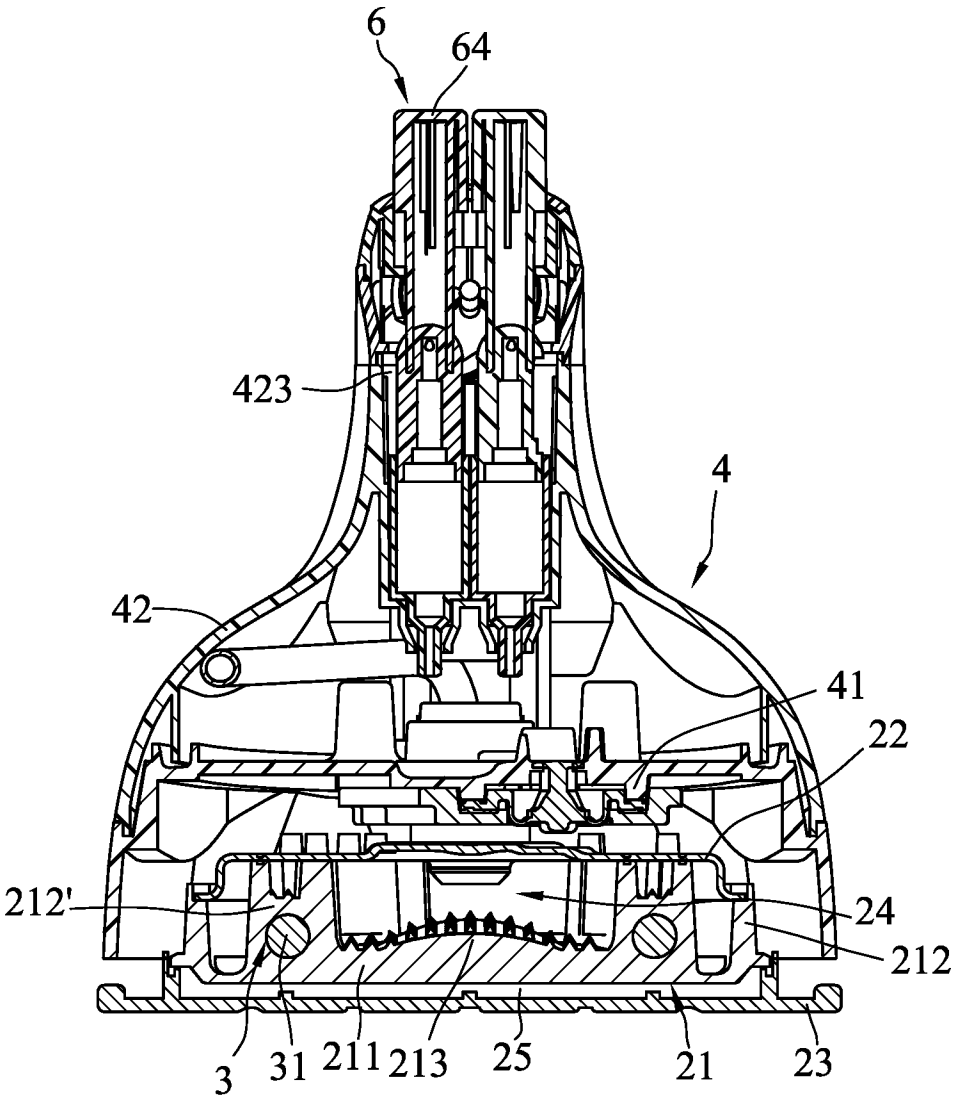
FIG. 4 is a sectional view taken along line IV-IV in FIG. 3.

Referring to FIGS. 2 to 4, an embodiment of a steam iron according to the disclosure is adapted for ironing a piece of cloth with steam generated thereby, and includes a machine body unit 4, a sole plate unit 2 that is connected to a bottom end of the machine body unit 4, a heating unit 3 that is connected to the sole plate unit 2, a water supply unit 5 that is connected to the machine body unit 4, and a control unit 6 that is connected to the machine body 4.

The sole plate unit 2 includes a hot plate 21, abase plate 22, and an ironing plate 23. The hot plate 21 has a plate wall 211 and two spaced apart outer and inner surrounding walls 212, 212' that extend upward from a peripheral portion of the plate wall 211. The plate wall 211 has a pointy front end and a wider rear end, and is formed with an upward protrusion 213 that is surrounded by the inner surrounding wall 212' and a plurality of through holes (not shown) that are disposed between the outer and inner surrounding walls 212, 212'. The base plate 22 is disposed below the machine body unit 4 and on top of the hot plate 21, and cooperates with the hot plate 21 to define a heating chamber 24 that is in fluid communication with the through holes. The ironing plate 23 is mounted at a bottom end of and in thermal contact with the hot plate 21 (i.e., the hot plate 21 is disposed between the machine body unit 4 and the ironing plate 23), is adapted for ironing the piece of cloth, and cooperates with the ironing plate 23 to define a spacing chamber 25 therebetween. The spacing chamber 25 acts as a temperature buffer between the hot plate 21 and the ironing plate 23, reducing the rate of temperature change of the ironing plate 23. The ironing plate 23 is formed with a plurality of steam holes 231 that are fluidly communicated with the spacing chamber 25 for applying the steam onto the piece of cloth.

The heating unit 3 includes a heating member 31 that is mounted in the hot plate 21 of the sole plate unit 2, and a temperature control member 32 that is mounted on the base plate 22 of the sole plate unit 2 and that is electrically connected to the heating member 31 for controlling temperatures of the heating member 31 and thus the hot plate 21.

The machine body unit 4 includes a base seat 41 that houses the water supply unit 5, a casing 42 that is mounted on the base seat 41, and a handle cover 43 that is mounted on the casing 42. The casing 42 has an inverted U-shaped handle portion 421 for a user to grip thereon and a case body portion 422 that covers the base seat 41. A top portion of the handle portion 421 is formed with a mounting groove 423 that can fit the control unit 6 therein. The case body portion 422 and the handle portion 421 cooperatively define handle space 44 for the user to extend his or her fingers therethrough, and the case body portion 422 and the base seat 41 cooperatively define a water tank chamber 45. The handle cover 43 is mounted to the handle portion 421 for sealing the mounting groove 423.

The water supply unit 5 includes a pump 51 that is mounted to the base seat 41 of the machine body unit 4, a pumping tube 52 that is fluidly connected to the water tank chamber 45, and a water-supplying tube 53 that extends through the base seat 41 to be in fluid communication with the heating chamber 24 of the sole plate unit 2, and that is adapted for supplying water to the hot plate 21 of the sole plate unit 2, in which the heating member 31 of the heating unit 3 heats up the hot plate 21 so that the water supplied to the hot plate 21 is heated to form the steam. Unless otherwise stated, water is assumed to be in liquid form and in room temperature.

The control unit 6 is mounted in the mounting groove 423 of the casing 42 of the machine body unit 4, and includes a three-axis accelerometer 61, a switch member 62 that is operable to turn on or off the three-axis accelerometer 61, a control circuit 63 that is electrically connected to the three-axis accelerometer 61 and the pump 51 of the water supply unit 5, and an air spray switch 64 that is electrically connected to the control circuit 63. In this embodiment, the three-axis accelerometer 61 is an ADXL 345 accelerometer, capable of measuring acceleration in a three-dimensional space within the range of 19.6 $m/s^2$ at 10-bit measurement. The switch member 62 is operable to turn off the three-axis accelerometer 61 when the user desires to dry iron, and therefore trigger the control circuit 63 to stop operation of the pump 51.

During operation of the steam iron of this disclosure, the pump 51 draws the water from the water tank chamber 45 through the pumping tube 52, and pump the water into the heating chamber 24 through the water-supplying tube 53. When the water is in direct contact with the protrusion 213 of the hot plate 21 in the heating chamber 24, as the hot plate 21 is heated by the heating member 31, the water evaporates into the steam, moves to the spacing chamber 25 through the through holes, and then leaves the spacing chamber 25 through the steam holes 231 to be in contact with the piece of cloth.

The three-axis accelerometer 61 measures acceleration of the steam iron and transmits a measured signal to the control circuit 63. The control circuit 63 transmits a control signal to the pump 51 based on the measured signal, such that the pump 51 supplies a corresponding amount of the water to the hot plate 21 of the sole plate unit 2 based on the control signal.

In this embodiment, the control unit 6 reduces the amount of the water supplied by the pump 51 (and consequently the amount of the steam generated) when the user swiftly irons a specific section of the piece of cloth. As swift movement from the user may suggest that presence of the crease on the piece of the cloth is minimal, the steam output is reduced accordingly. On the other hand, the control unit 6 increases the amount of the steam generated, by increasing the amount of the water supplied by the pump 51, when the user irons slowly, as such movement may suggest great presence of crease on the piece of cloth.

Specifically, in this embodiment, the control unit 6 controls the output of the steam based off the following programmed logistics:

1) The three-axis accelerometer 61 has a minimum detectable acceleration value. In this embodiment, the minimum detectable acceleration value is (19.6÷1024) $m/s^2$, or 0.01914 $m/s^2$. The three-axis accelerometer 61 continuously measures the acceleration of the steam iron every 50 milliseconds (ms) throughout the operation of the steam iron. For every ninety consecutive measurements of the acceleration, the control unit 6 compares the measured value with 9 times the minimum detectable acceleration value (or 0.17227 $m/s^2$ in this embodiment). When the measured value is less than 9 times the minimum detectable acceleration value in more than seventy-nine measurements out of the ninety measurements, the three-axis accelerometer 61 transmits the measured signal to the control circuit 63 to stop the pump 51 from supplying the water to the hot plate 21.

2) The steam iron has a maximum steam output, denoted M. The control circuit 63 is configured to control steam output of the steam iron to be (1/N)*M where N ranges from 1 to 7. The three-axis accelerometer 61 continuously measures the acceleration of the steam iron every 50 ms, and compares each measured value of acceleration of the steam iron with a previous measured value of acceleration of the steam iron 50 ms ago. The three-axis accelerometer 61 transmits the measured signal to the control circuit 63 to control the pump 51 such that the steam iron decreases the steam output thereof when the difference between the measured value of acceleration of steam iron with the previous measured value of acceleration of the steam iron is greater than 50 times the minimum detectable acceleration value (or 0.95703 $m/s^2$ in this embodiment). On the other hand, the three-axis accelerometer 61 transmits the measured signal to the control circuit 63 to control the pump 51 such that the steam iron increases the steam output thereof when the difference between the measured value of acceleration of steam iron with the previous measured value of acceleration of the steam iron is smaller than 50 times the minimum detectable acceleration value.

3) The steam output of the steam iron is initially set to be (1/N)*M where N equals to 3. In each comparison, N increases by 1 when the difference between the measured value of acceleration with the previous measured acceleration of the steam iron is greater than 50 times the minimum detectable acceleration value, and N decreases by 1 when the difference between the measured value of acceleration with the previous measured value of acceleration is smaller than 50 times the minimum detectable acceleration value.

In actual use, instead of relying on the control unit 6 for monitoring the steam output, the user may operate the air spray switch 64 to control the control circuit 63 to manually increase the amount of the water supplied to the hot plate 21 by the pump 51, such that steam output of the steam iron is increased.

Overall, by directly adding the water to the hot plate 21 to generate steam, the steam iron of this disclosure does not need a dedicated steam chamber or multiple heating members. The control circuit 63 transmits a control signal to the pump 51 based on the measured signal from the three-axis accelerometer 61, such that the pump 51 supplies a corresponding amount of the water to the hot plate 21 of the sole plate unit 2 based on the control signal.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A steam iron adapted for ironing a piece of cloth with steam generated thereby, said steam iron comprising:

a machine body unit;

a sole plate unit connected to a bottom end of said machine body unit;

a water supply unit connected to said machine body unit and including a pump that is adapted for supplying water to said sole plate unit;

a heating unit connected to said sole plate unit and heating up said sole plate unit so that the water supplied to said sole plate unit is heated to form the steam; and a control unit connected to said machine body unit, measuring moving speed of said steam iron and controlling water output of said pump based on the moving speed of said steam iron;

wherein said control unit includes a three-axis accelerometer, a control circuit that is electrically connected to said three-axis accelerometer and said pump of said water supply unit, and a switch member that is operable to turn on and to turn off operation of said three-axis accelerometer;

wherein said three-axis accelerometer measures acceleration of said steam iron and transmits a measured signal to said control circuit;

wherein said control circuit transmits a control signal to said pump based on the measured signal such that said pump supplies a corresponding amount of the water to said sole plate unit based on the control signal; and wherein said control unit reduces the amount of the water supplied by the pump when the moving speed of said steam iron increases, and increases the amount of the water supplied by the pump when the moving speed of said steam iron decreases.

2. The steam iron as claimed in claim 1, wherein said control unit further includes a steam switch that is electrically connected to said control circuit and that is operable to control said control circuit to increase the amount of the water supplied to said sole plate unit by said pump such that steam output of said steam iron is increased.

3. The steam iron as claimed in claim 1, wherein said heating unit includes a heating member that is mounted in said sole plate unit for heating said sole plate unit, and a temperature control member electrically connected to said heating member for controlling temperatures of said heating member and thus said sole plate unit.

4. The steam iron as claimed in claim 1, wherein:

said sole plate unit includes a hot plate that is heated by said heating unit, and an ironing plate that is in thermal contact with said hot plate and that is adapted for ironing the piece of cloth; and said hot plate is disposed between said machine body unit and said ironing plate, and cooperates with said ironing plate to define a spacing chamber therebetween for reducing the rate of temperature change of said sole plate unit.

* * * * *